US008941383B2

(12) United States Patent
Hopper et al.

(10) Patent No.: US 8,941,383 B2
(45) Date of Patent: Jan. 27, 2015

(54) SYSTEM AND METHOD FOR MEASURING BOREHOLE GEOMETRY WHILE DRILLING

(75) Inventors: Tim Hopper, Mt. Claremont (AU); Nicholas J. Heaton, Houston, TX (US); David T. Oliver, Sugar Land, TX (US); Luis E. Depavia, Sugar Land, TX (US); Yi-Qiao Song, Newton, MA (US); Martin D. Hurlimann, Newton, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 386 days.

(21) Appl. No.: 13/287,877

(22) Filed: Nov. 2, 2011

(65) Prior Publication Data

US 2013/0106413 A1 May 2, 2013

(51) Int. Cl.
*G01V 3/00* (2006.01)
*E21B 47/08* (2012.01)

(52) U.S. Cl.
CPC ..... *E21B 47/082* (2013.01)
USPC ..... 324/309

(58) Field of Classification Search
USPC ..... 324/300–322
See application file for complete search history.

(56) References Cited

U.S. PATENT DOCUMENTS

| | | | | |
|---|---|---|---|---|
| 6,121,773 | A | 9/2000 | Taicher et al. | |
| 7,966,874 | B2 * | 6/2011 | Hassan et al. | 73/152.03 |
| 8,060,310 | B2 * | 11/2011 | Tabarovsky et al. | 702/9 |
| 8,364,404 | B2 * | 1/2013 | Legendre et al. | 702/5 |
| 2004/0090230 | A1 | 5/2004 | Appel et al. | |
| 2006/0097722 | A1 | 5/2006 | Scheven | |
| 2008/0174313 | A1 | 7/2008 | Ganesan | |

FOREIGN PATENT DOCUMENTS

WO 2004140560 A2 12/2004

OTHER PUBLICATIONS

International Search Report and Written Opinion for International Application No. PCT/US2012/063150 mailed Feb. 26, 2013.

* cited by examiner

*Primary Examiner* — Dixomara Vargas
(74) *Attorney, Agent, or Firm* — Kimberly Ballew

(57) ABSTRACT

A method and system for determining a geometry of a borehole includes forming an nuclear magnetic resonance (NMR) caliper with a plurality of coils and coupling the NMR caliper to a borehole assembly. The NMR caliper may be calibrated for porosity and the T2 of the drilling mud, prior to drilling, at the surface. After drilling commences, scans of the borehole may be conducted with each coil of the NMR caliper. Each scan may include propagating RF energy across a range of frequencies with each coil in order to excite a NMR signal at varying depths. Borehole wall distances from the NMR caliper may be determined by reviewing a plurality of T2 distributions from CPMG measurements derived from the scans. In some embodiments, borehole wall distances from the NMR caliper may be determined by reviewing porosity values derived from the scans.

14 Claims, 15 Drawing Sheets

SYSTEM AND METHOD FOR MEASURING BOREHOLE GEOMETRY WHILE DRILLING

BACKGROUND

Several conventional logging while drilling ("LWD") calipers currently exist. Of these, the ultrasonic calipers generally offer a good and direct measurement. This caliper may offer precision azimuthal hole shape definition in suitable environments and is generally not restricted to specific mud types.

For robust ultrasonic caliper measurements, it is desirable that acoustic properties of the mud are known or can be derived, and that there is sufficient contrast in acoustic impedance between the mud and formation wall. Unfortunately, these boundary conditions associated with mud sometimes cannot be calculated.

Meanwhile, other conventional azimuthal LWD calipers have a limited depth of investigation range and are susceptible to mud types, and in particular, high barite muds. In other caliper options, density and neutron based measurements can be used to derive non-directional caliper information. These LWD calipers may have the advantage that they are feasible in sliding mode, but as with most neutron log measurements, the neutron caliper is sensitive to mud properties and eccentering. The azimuthal information from the density caliper cannot be obtained when the tool is sliding as there is generally one sensor. The term sliding refers to non-rotation of the bottom-hole assembly, such as occurs when drilling with a mud motor, tripping into a well, or tripping out of a well.

Other calipers include propagation resistivity tools. Such resistivity tools used as calipers may offer good quality caliper information in water based muds and can be derived from conventionally acquired data as a byproduct of an inversion. However, these resistivity tools as well as the other conventional calipers mentioned above are limited in that they cannot provide consistent and dependable high quality caliper measurements across various types of conditions, including different mud types and during washout conditions while providing measurements at different depth ranges.

SUMMARY

A method and system for determining a geometry of a borehole includes forming an nuclear magnetic resonance (NMR) caliper with a plurality of coils and coupling the NMR caliper to a borehole assembly. After drilling commences, NMR scans of the borehole may be conducted with each coil.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass parts having the same reference numeral in the figures.

DETAILED DESCRIPTION

Figure 1A:
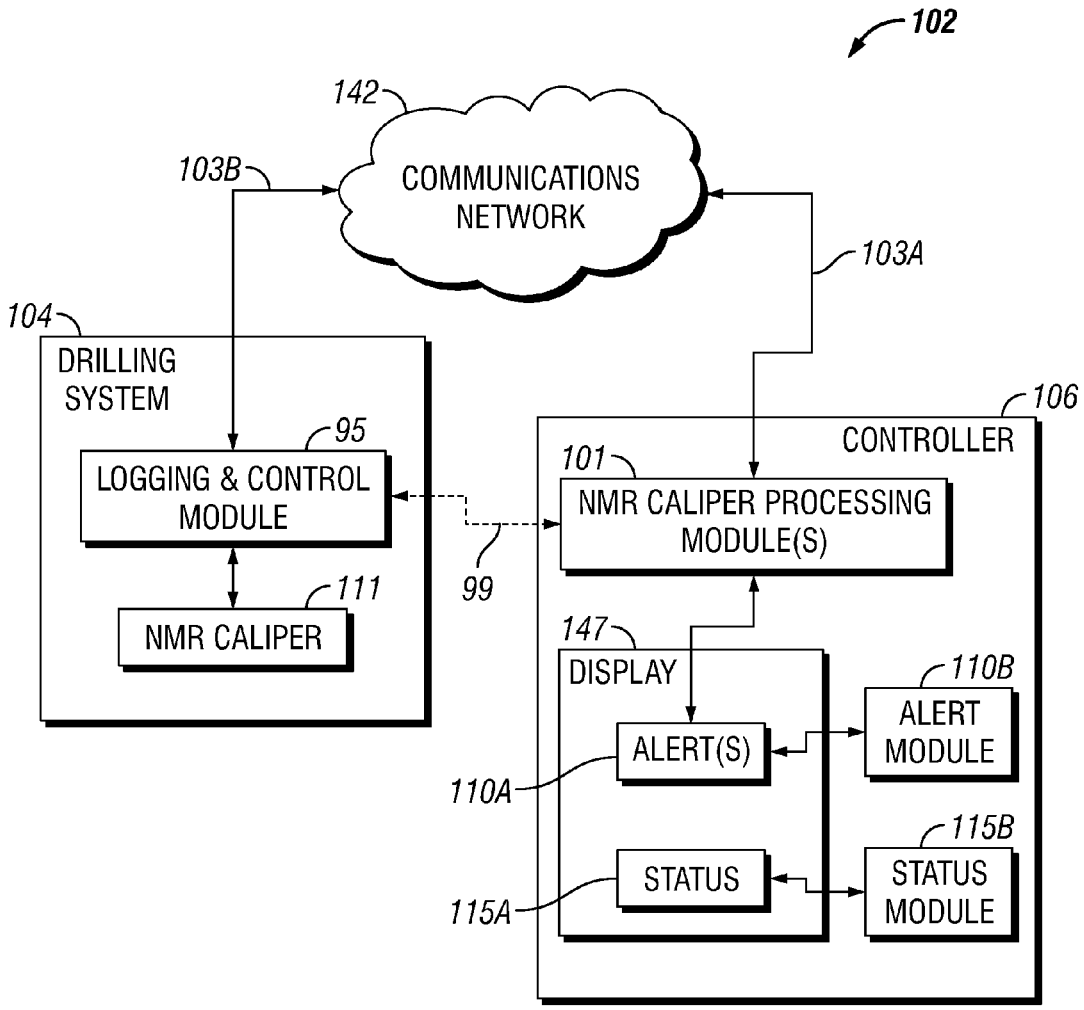
FIG. 1A is a diagram of a system for measuring borehole geometry while drilling.

Referring initially to FIG. 1A, this figure is a diagram of a system 102 for measuring borehole geometry while drilling. The system 102 includes a controller 106, a nuclear magnetic resonance ("NMR") caliper processing module 101, and an NMR caliper 111. Further details of the NMR caliper 111 will be described below in connection with FIGS. 1C-1E.

The system 102 also includes a drilling system 104 which has a logging and control module 95. The controller 106 further comprises a display 147 for conveying alerts 110A and status information 115A that are produced by an alerts module 110B and a status module 115B. The controller 106 may communicate with the drilling system 104 via a communications network 142.

The controller 106 and the drilling system 104 may be coupled to the communications network 142 via communication links 103. Many of the system elements illustrated in FIG. 1A are coupled via communications links 103 to the communications network 142.

The links 103 illustrated in FIG. 1A may comprise wired or wireless couplings or links. Wireless links include, but are not limited to, radio-frequency ("RF") links, infrared links, acoustic links, and other wireless mediums. The communications network 142 may comprise a wide area network ("WAN"), a local area network ("LAN"), the Internet, a Public Switched Telephony Network ("PSTN"), a paging network, or a combination thereof. The communications network 142 may be established by broadcast RF transceiver towers (not illustrated). However, one of ordinary skill in the art recognizes that other types of communication devices besides broadcast RF transceiver towers are included within the scope of this disclosure for establishing the communications network 142.

The drilling system 104 and controller 106 of the system 102 may have RF antennas so that each element may establish wireless communication links 103 with the communications network 142 via RF transceiver towers (not illustrated). In some embodiments, the controller 106 and drilling system 104 of the system 102 may be directly coupled to the communications network 142 with a wired connection. The controller 106 in some instances may communicate directly with the drilling system 104 as indicated by dashed line 99 or the controller 106 may communicate indirectly with the drilling system 104 using the communications network 142.

NMR caliper processing module 101 may comprise software or hardware (or both). The NMR caliper processing module 101 may generate the alerts 110A relating to borehole shape that may be rendered on the display 147. The alerts 110A may be visual in nature but they may also comprise audible alerts as understood by one of ordinary skill in the art.

The display 147 may comprise a computer screen or other visual device. The display 147 may be part of a separate stand-alone portable computing device that is coupled to the logging and control module 95 of the drilling system 104. The logging and control module 95 may comprise hardware or software (or both) for direct control of a borehole assembly 100 as understood by one of ordinary skill in the art.

Figure 1B:
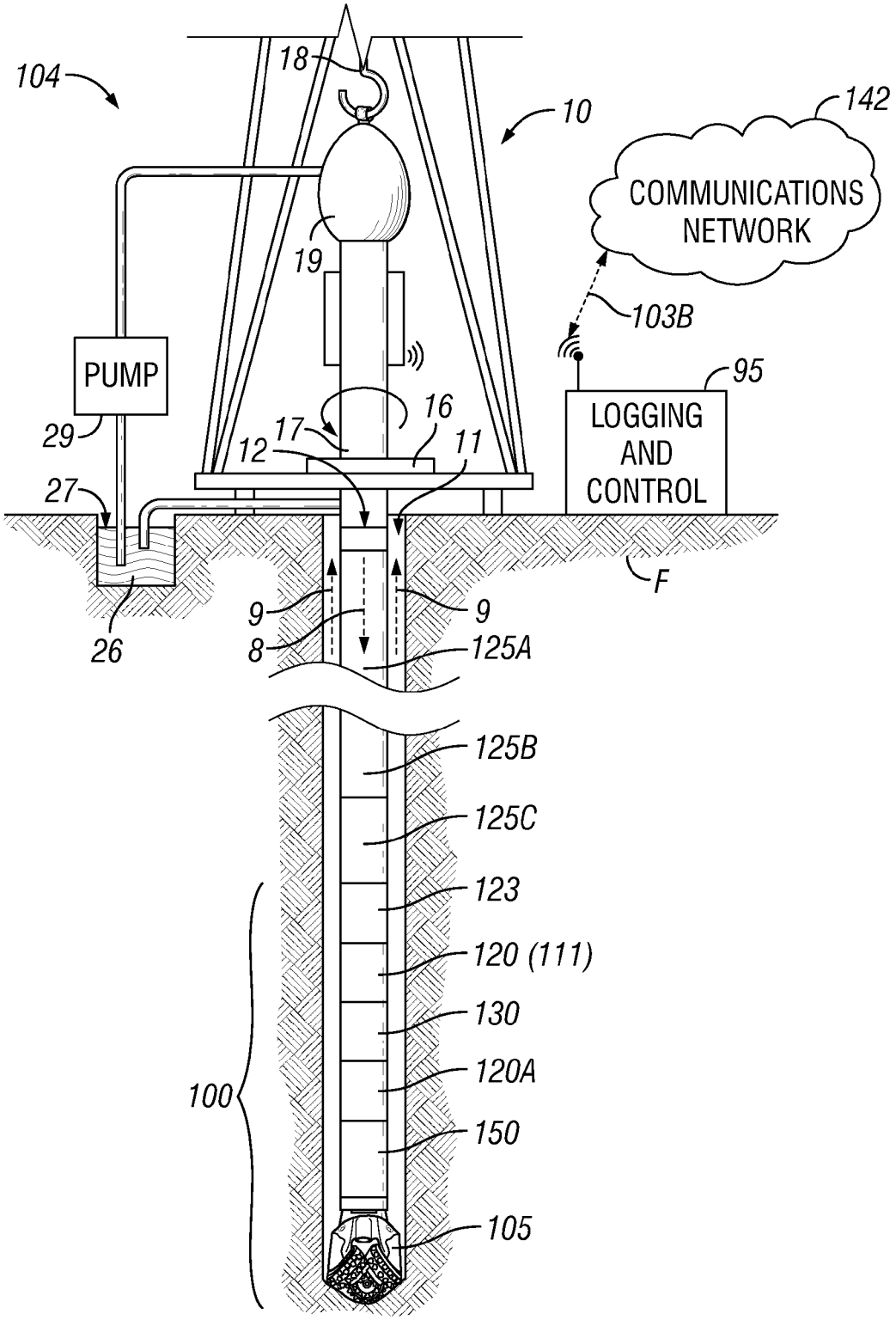
FIG. 1B is a diagram of a wellsite drilling system that forms part of the system illustrated in FIG. 1A.

FIG. 1B illustrates a wellsite drilling system 104 that forms part of the system 102 illustrated in FIG. 1A. The wellsite can be onshore or offshore. In this system 104, a borehole 11 is formed in subsurface formations by rotary drilling in a manner that is known to one of ordinary skill in the art. Embodiments of the system 104 can also use directional drilling, as will be described hereinafter. The drilling system 104 comprises the logging and control module 95 as discussed above in connection with FIG. 1A.

A drill string 12 is suspended within the borehole 11 and has a bottom hole assembly ("BHA") 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by mechanisms not shown, which engages the kelly 17 at the upper end of the drill string. The drill string 12 is suspended from a hook 18, attached to a traveling block (also not shown), through the kelly 17 and a rotary swivel 19 which permits rotation of the drill string 12 relative to the hook 18. As is known to one of ordinary skill in the art, a top drive system could be used instead of the kelly 17 and rotary table 16 to rotate the drill string 12 from the surface. The drill string 12 may be assembled from a plurality of segments 125 of pipe and/or collars threadedly joined end to end.

In the embodiment of FIG. 1B, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this system as understood by one of ordinary skill in the art, the drilling fluid 26 lubricates the drill bit 105 and carries formation cuttings up to the surface as it is returned to the pit 27 for cleaning and recirculation.

The bottom hole assembly 100 of the illustrated embodiment may include a logging-while-drilling (LWD) module 120, a measuring-while-drilling (MWD) module 130, a roto-steerable system and motor 150, and drill bit 105.

The LWD module 120 is housed in a special type of drill collar, as is known to one of ordinary skill in the art, and can contain one or a plurality of known types of logging tools. It will also be understood that more than one LWD 120 and/or MWD module 130 can be employed, e.g. as represented at 120A and 120B. (References, throughout, to a module at the position of 120A may include a module at the position of 120B as well.) The LWD module 120 includes capabilities for measuring, processing, and storing information, as well as for communicating with the surface equipment. In the embodiment of FIG. 1B, the first LWD module 120A includes a directional resistivity measuring device. The second LWD module 120B may include an NMR caliper 111 as will be described below. While the position of the NMR 111 caliper has been illustrated in the second LWD module 120B, the NMR caliper may easily be positioned in the first LWD module 120A as desired by one of ordinary skill in the art. The spatial arrangement and sequence of the LWD modules 120 relative to other parts of the borehole assembly ("BHA") 100 may be interchanged as recognized by one of ordinary skill in the art.

The MWD module 130 is also housed in a special type of drill collar, as is known to one of ordinary skill in the art, and can contain one or more devices for measuring characteristics of the drill string 12 and drill bit 105. The MWD module 130 may further includes an apparatus (not shown) for generating electrical power to the downhole system 100.

This apparatus may include a mud turbine generator powered by the flow of the drilling fluid 26, it being understood by one of ordinary skill in the art that other power and/or battery systems may be employed. In the embodiment, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The foregoing examples of wireline and drill string conveyance of a well logging instrument are not to be construed as a limitation on the types of conveyance that may be used for the well logging instrument. Any other conveyance known to one of ordinary skill in the art may be used, including without limitation, slickline (solid wire cable), coiled tubing, well tractor and production tubing.

Figure 1C:
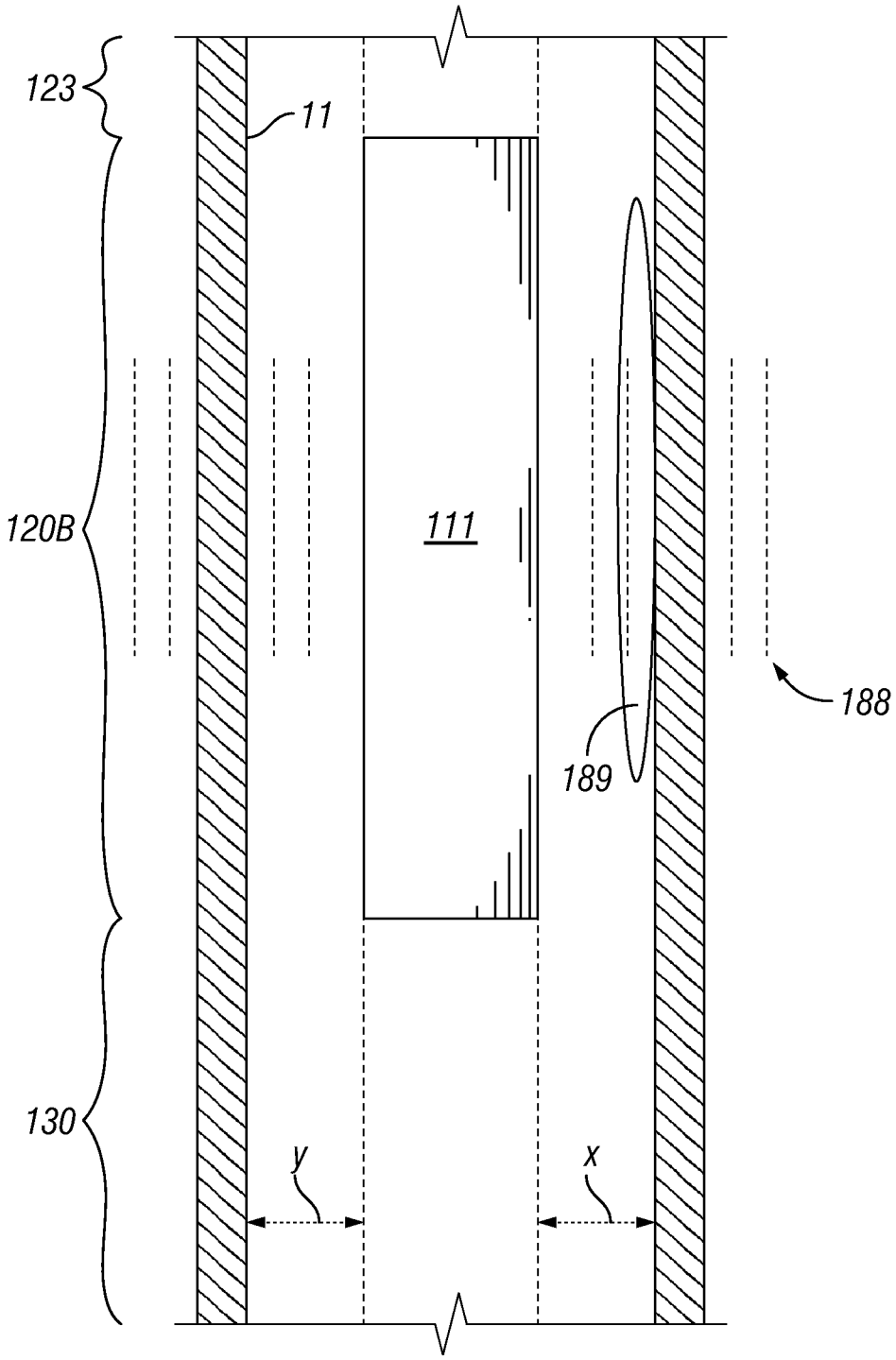
FIG. 1C illustrates a nuclear magnetic resonance ("NMR") caliper and its associated RF pulses generated within a borehole.

FIG. 1C illustrates a nuclear magnetic resonance ("NMR") caliper 111 and its associated RF pulses 188 generated within a borehole. As understood by one of ordinary skill in the art, the NMR caliper can be an NMR tool or device, and may comprise a plurality of coils 107 (not illustrated in this Figure but see FIGS. 1D & 1E) which produce the RF pulses 188. The range of frequencies that may be generated by the NMR caliper 111 may range between about 100 kHz to about 2 MHz. The NMR signal created by the appropriate application of the RF pulses 188 may be used by the NMR caliper 111 to determine the distance X and distance Y between the NMR caliper 111 and the borehole wall 11.

As understood by one of ordinary skill in the art, the frequency is dependent on the static magnetic field provided by the tools magnets. For a gradient field, the frequency decreases with increasing distance from the tool face. Thus, the lower frequency ranges expand an investigation range to longer distances while the higher frequency ranges contract or shorten the investigation range relative to a surface or face of the NMR caliper 111. For example, the frequency of about 2 MHz may provide an investigation of approximately ½ inch (approx. 1.27 cm) relative to a face of the caliper 111 while the frequency of about 100 kHz may extend the investigation range to between about 4 to 5 inches (approx. 10.16 cm to approx. 12.70 cm) relative to the face of the caliper 111. Other frequencies expanding or contracting the investigation range of the NMR caliper 111 are within the scope of this disclosure. In some embodiments, the depth of investigation can be changed (whether from shallow to deep or vice-versa) by dynamically changing the static magnetic field while keeping the frequency constant.

One advantage of the NMR caliper 111 is that it can calibrate its measurements against mud 189 as illustrated in FIG. 1C. That is, mud 189 at the surface or near the surface of the well such as near the platform and derrick assembly 10 as illustrated in FIG. 1B may be measured and then accounted for as the bottom hole assembly 100 penetrates through the earth. It has been found that drilling mud as measured on surface 189 has similar characteristics of the drilling mud used in the borehole.

Figure 1D:
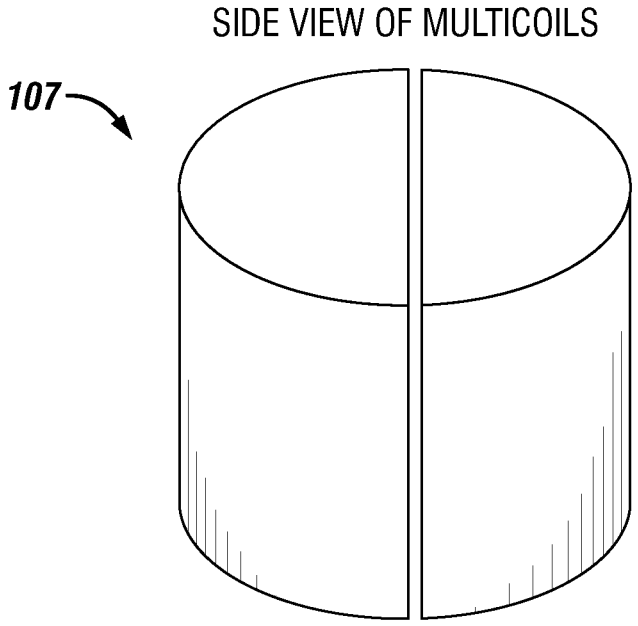
FIG. 1D illustrates a side view of coils for a nuclear magnetic resonance ("NMR") caliper.

FIG. 1D illustrates a side view of coils 107 for a nuclear magnetic resonance ("NMR") caliper 111. According to this embodiment and the embodiment illustrated in FIG. 1E, the number of separate coils 107 is four such that each coil covers a sector shaped region (relative to theoretical geometric rays that would originate from a geometric center of the BHA 100) around the cylindrically shaped BHA 100. The size of each sector is approximately ninety degrees. However, other NMR calipers 111 having fewer or a greater number of coils 107 are included within the scope of this disclosure as understood by one of ordinary skill in the art. Further the NMR caliper 111 is not limited to partial cylindrical shapes. Other geometric shapes, especially when more than four coils 107 are deployed, are within the scope of this disclosure.

Figure 1E:
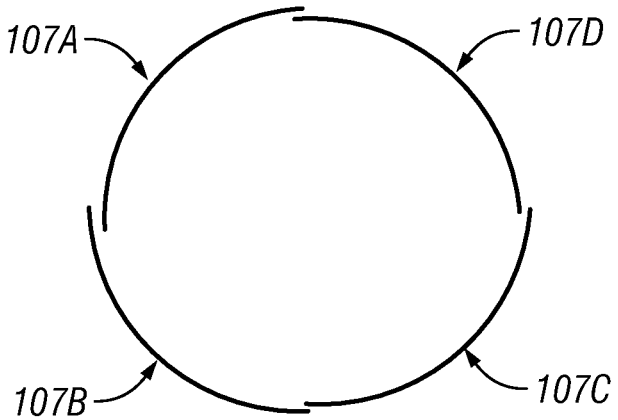
FIG. 1E is an elevational view of the coils illustrated in FIG. 1D.

FIG. 1E is an elevational view of the four coils 107 illustrated in FIG. 1D. The four coils 107A-107B each cover a sector shaped region relative to the cylindrical shaped BHA 100 to which they are attached. The coils 107 may be produced from any suitable metal, such as copper. An appropriate number of windings for each coil 107 may be made as understood by one of ordinary skill in the art. The coils may be controlled by the NMR control module 101. The number of windings for each coil depends on the size of the collar and the requisite inductance. As may be recognized by one of ordinary skill in the art having benefit of the present disclosure, an appropriate number of windings can be calculated and/or determined based on the size of the collar and the number of coils used in the array. In some embodiments, the number ranges between one and ten windings.

The coils 107 may be designed and operated such NMR processing/control module 101 produces sweeps across the frequency range of about 2 MHz to about 100 kHz for each coil and at the same time. That is, each coil will operate at the same frequency for a given instant of time while the sweep across the disclosed frequency range is made by NMR processing module 101. In this way, each coil 107 is measuring about the same distance from its surface at a given instant in time. In the embodiment of FIG. 1E, the coils 107 overlap one another along their edges. The coils are designed to overlap each other so as to cancel the field created by the wire in the long axis of the coils. By having opposing directions of current flow in adjacent coils, we can reduce this unwanted EM field contribution.

Figure 1F:
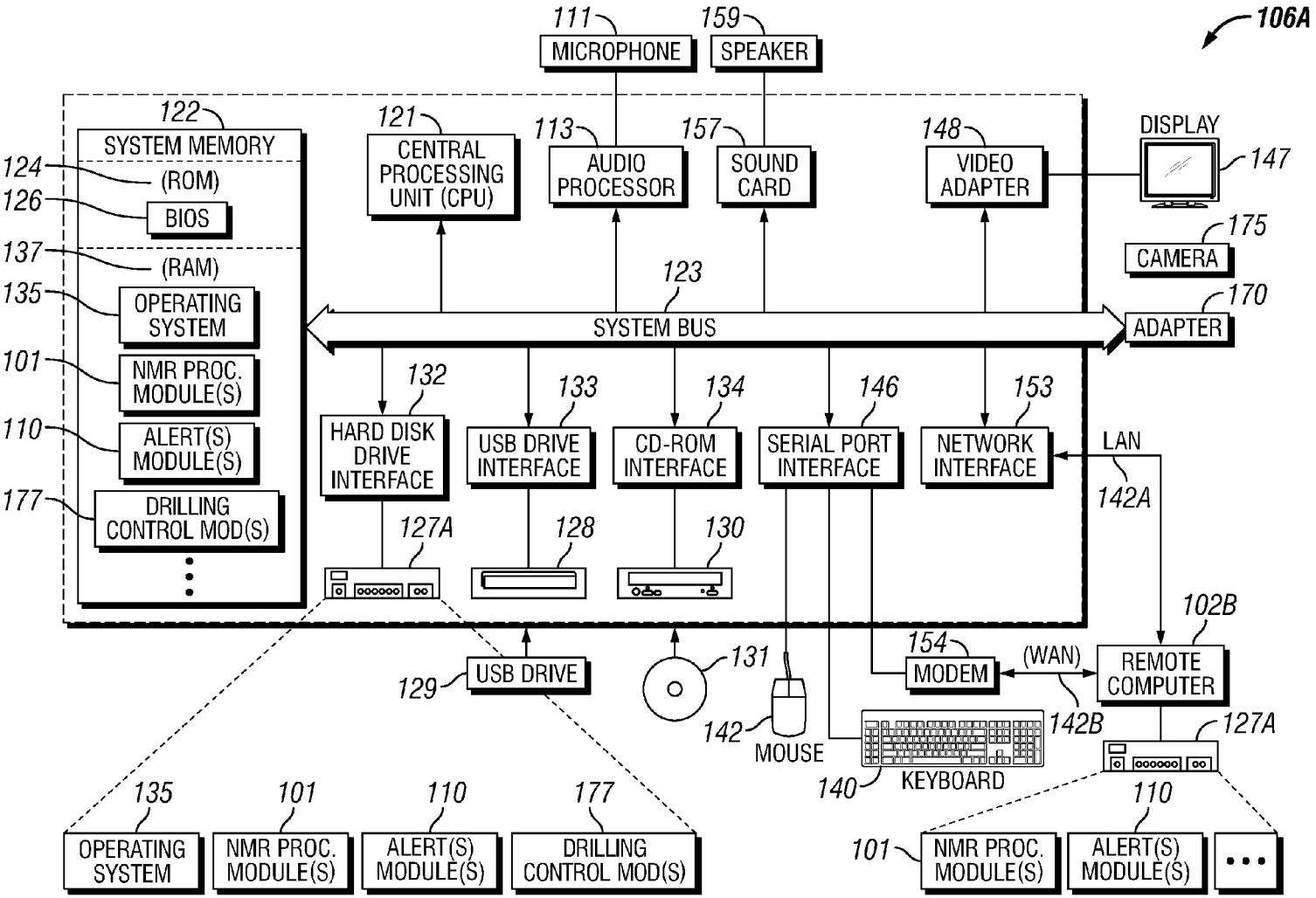
FIG. 1F is a diagram of some computer based elements for controlling a nuclear magnetic resonance ("NMR") caliper.

FIG. 1F is a diagram of some computer based elements in the controller 106 for controlling a nuclear magnetic resonance ("NMR") caliper 111 of the wellsite drilling system 104 of FIG. 1A. The operating environment for the controller 106 may include a general-purpose computing device in the form of a conventional computer as understood by one of ordinary skill in the art.

Generally, the computer forming the controller 106 includes a central processing unit 121, a system memory 122, and a system bus 123 that couples various system components including the system memory 122 to the processing unit 121.

The system bus 123 may be any of several types of bus structures including a memory bus or memory controller, a peripheral bus, and a local bus using any of a variety of bus architectures. The system memory includes a read-only memory ("ROM") 124 and a random access memory ("RAM") 127. A basic input/output system ("BIOS") 126, containing the basic routines that help to transfer information between elements within computer, such as during start-up, is stored in ROM 124.

The computer 106 can include a hard disk drive 127A for reading from and writing to a hard disk, not shown, a USB port 128 for reading from or writing to a removable USB drive 129, and an optical disk drive 130 for reading from or writing to a removable optical disk 131 such as a CD-ROM, a DVD, or other optical media. Hard disk drive 127A, USB drive 129, and optical disk drive 130 are connected to system bus 123 by a hard disk drive interface 132, a USB drive interface 133, and an optical disk drive interface 134, respectively.

Although the environment described herein employs hard disk 127A, removable USB drive 129, and removable optical disk 131, it should be appreciated by one of ordinary skill in the art that other types of computer readable media which can store data that is accessible by a computer, such as magnetic cassettes, flash memory cards, digital video disks, Bernoulli cartridges, RAMs, ROMs, and the like, may also be used in the operating environment without departing from the scope of the system 102. Such uses of other forms of computer readable media besides the hardware illustrated will be used in internet connected devices such as in a portable computing device, like a laptop computer or a handheld computer.

The drives and their associated computer readable media illustrated in FIG. 1F provide nonvolatile storage of computer-executable instructions, data structures, program modules, and other data for computer or client device 102A. A number of program modules may be stored on hard disk 127, USB drive 129, optical disk 131, ROM 124, or RAM 137, including, but not limited to, an NMR processing module 101 and an alert module 110, and other drilling control modules 177. Program modules may include, but are not limited to, routines, sub-routines, programs, objects, components, data structures, etc., which perform particular tasks or implement particular abstract data types.

A user may enter commands and information into the computer 106A through input devices, such as a keyboard 140 and a pointing device 142. Pointing devices may include a mouse, a trackball, finger input, and/or an electronic pen that can be used in conjunction with an electronic tablet. Other input devices (not shown) may include a joystick, game pad, satellite dish, scanner, or the like. These and other input devices are often connected to processing unit 121 through a serial port interface 146 that is coupled to the system bus 123, but may be connected by other interfaces, such as a parallel port, game port, a universal serial bus (USB), or the like.

The display 147 may also be connected to system bus 123 via an interface, such as a video adapter 148. As noted above, the display 147 can comprise any type of display devices such as a liquid crystal display (LCD), a plasma display, an organic light-emitting diode (OLED) display, and a cathode ray tube (CRT) display.

The camera 175 may also be connected to system bus 123 via an interface, such as an adapter 170. The camera 175 may comprise a video camera. The camera 175 can be a CCD (charge-coupled device) camera or a CMOS (complementary metal-oxide-semiconductor) camera. In addition to the monitor 147 and camera 175, the client device 100A, comprising a computer, may include other peripheral output devices (not shown), such as a printer.

The computer may also include a microphone 111 that is coupled to the system bus 123 via an audio processor 113 is understood by one of ordinary skill in the art. A microphone 111 may be used in combination with the voice recognition module 206 in order to process audible commands received from an operator.

The computer forming the central controller 106A may operate in a networked environment using logical connections to one or more remote computers, such as a web server. A remote computer 106B may be another personal computer, a server, a mobile phone, a router, a networked PC, a peer device, or other common network node. While the web server or a remote computer 106B may include many of the elements described above relative to the controller 106A, a memory storage device 127B has been illustrated in this FIG. 1C. The logical connections depicted in FIG. 1C include a local area network (LAN) 142 and a wide area network (WAN) 142B. Such networking environments are commonplace in offices, enterprise-wide computer networks, intranets, and the Internet.

When used in a LAN networking environment, the computer forming the controller 106A is often connected to the local area network 142A through a network interface or adapter 153. When used in a WAN networking environment, the computer 106A may include a modem 154 or other means for establishing communications over WAN 142B, such as the Internet. Modem 154, which may be internal or external, is connected to system bus 123 via serial port interface 146. In a networked environment, program modules depicted relative to the server 102B, or portions thereof, may be stored in the remote memory storage device 127A. It will be appreciated that the network connections shown are just examples and other means of establishing a communications link between the computers may be used.

Moreover, those skilled in the art will appreciate that the system 102 may be implemented in other computer system configurations, including hand-held devices, multiprocessor systems, microprocessor based or programmable consumer electronics, network personal computers, minicomputers, mainframe computers, and the like. The system 102 may also be practiced in distributed computing environments, where tasks are performed by remote processing devices that are linked through a communications network. In a distributed computing environment, program modules may be located in both local and remote memory storage devices.

Figure 2B:
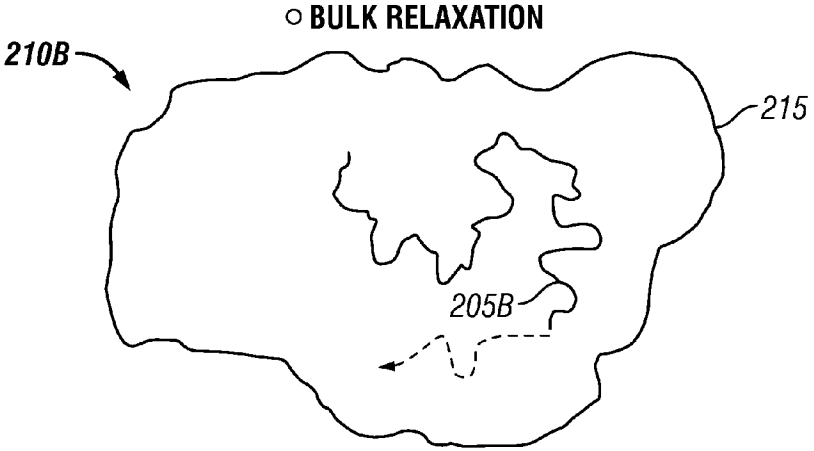
FIG. 2B is a diagram illustrating bulk relaxation as it relates to nuclear magnetic resonance ("NMR") measurements.
Figure 2A:
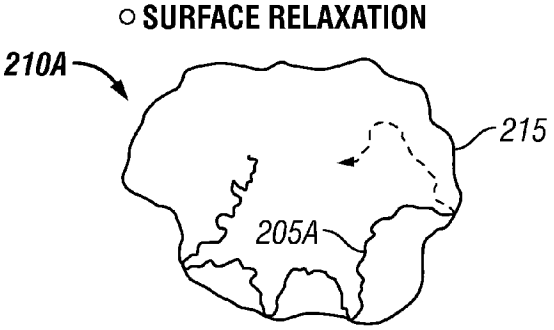
FIG. 2A is a diagram illustrating surface relaxation as it relates to nuclear magnetic resonance ("NMR") measurements.

FIG. 2A is a diagram illustrating surface relaxation as it relates to nuclear magnetic resonance ("NMR") measurements. As understood by one of ordinary skill may art, surface relaxation relates to how protons (a single proton is identified by its movement trace 205A is illustrated in FIG. 2A) interact with the wall or walls 215 of a pore 210A. It is assumed that the pore 210A is filled with a fluid. The pore 210 may be formed by within a rock. As the proton hits the walls 215 of the pore 210A, it loses energy as indicated by the movement trace 205A caused by an RF pulse 188.

The time measured while the proton is losing energy is often referred to as relaxation time as understood by one of ordinary skill in the art. Relaxation time may include T1 time and T2 time.

T1 relaxation time, as understood by one of ordinary skill in the art, refers to the spin-lattice relaxation and the decay constant for the recovery of the z component (longitudinal) of the nuclear spin magnetization vector M parallel to the external magnetic field, Bo. Once the nuclear spins in a population of atoms for a pore 210A is relaxed, the population can be probed again with an RF signal, since the population has returned to an initial, equilibrium (mixed) state.

T2 relaxation time refers to the spin-spin relaxation time and is the decay constant for the component of the magnetization perpendicular to the static magnetic field, Bo. Because of the difference in the actual relaxation mechanisms involved (for example, inter-molecular versus intra-molecular magnetic dipole-dipole interactions) T1 time is, in many cases, longer than T2 time. The T2 relaxation time in a pore system with one fluid type, is a sum of relaxation times that can be correlated with the pore size distribution from the surface relaxation.

T1 and T2 times are calculated from the surface relaxation illustrated in FIG. 2A as well as from bulk relaxation as illustrated in FIG. 2B. Specifically, FIG. 2B is a diagram illustrating bulk relaxation as it relates to nuclear magnetic resonance ("NMR") measurements. In FIG. 2B, fluid is contained within walls 215 of a much larger pore 210B. According to bulk relaxation, protons within the fluid are being measured and do not interact with the walls 215 of the pore 210B.

Figure 2C:
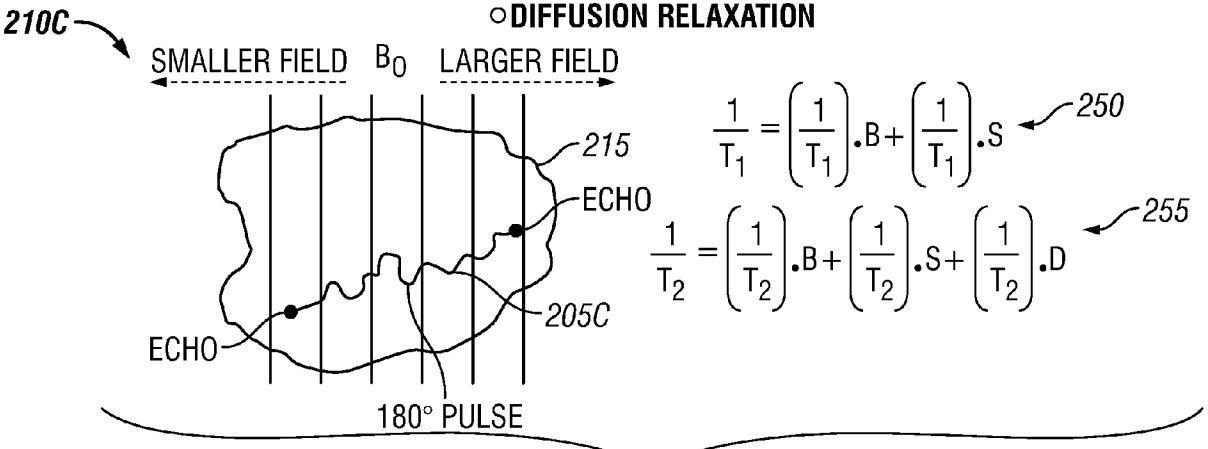
FIG. 2C is a diagram illustrating diffusion relaxation as it relates to nuclear magnetic resonance ("NMR") measurements.

In addition to bulk relaxation in surface relaxation, T2 relaxation also involves diffusion-based relaxation. If the nuclear spins are moving within a volume in which the magnetic field is changing, i.e a gradient, then the precessional frequency is changing during the NMR sequence. When this happens, the NMR signal can be lost or reduced. FIG. 2C is a diagram illustrating diffusion relaxation as it relates to nuclear magnetic resonance ("NMR") measurements.

However, with diffusion relaxation, many gradients may exist and therefore, this variable is, in many cases, not calculated in NMR measurements. Equation 250 of FIG. 2C illustrates that T1 time is a function of both bulk relaxation ("B") and surface relaxation ("S"). Specifically, T1 may be calculated from the sum of the bulk and surface relaxations. Meanwhile, as indicated by equation 255, T2 time is a function of bulk relaxation ("B"), surface relaxation ("S"), and diffusion relaxation ("D"), although the diffusion relaxation parameter may be ignored in fields in which there is a low magnetic field gradient.

Figure 3:
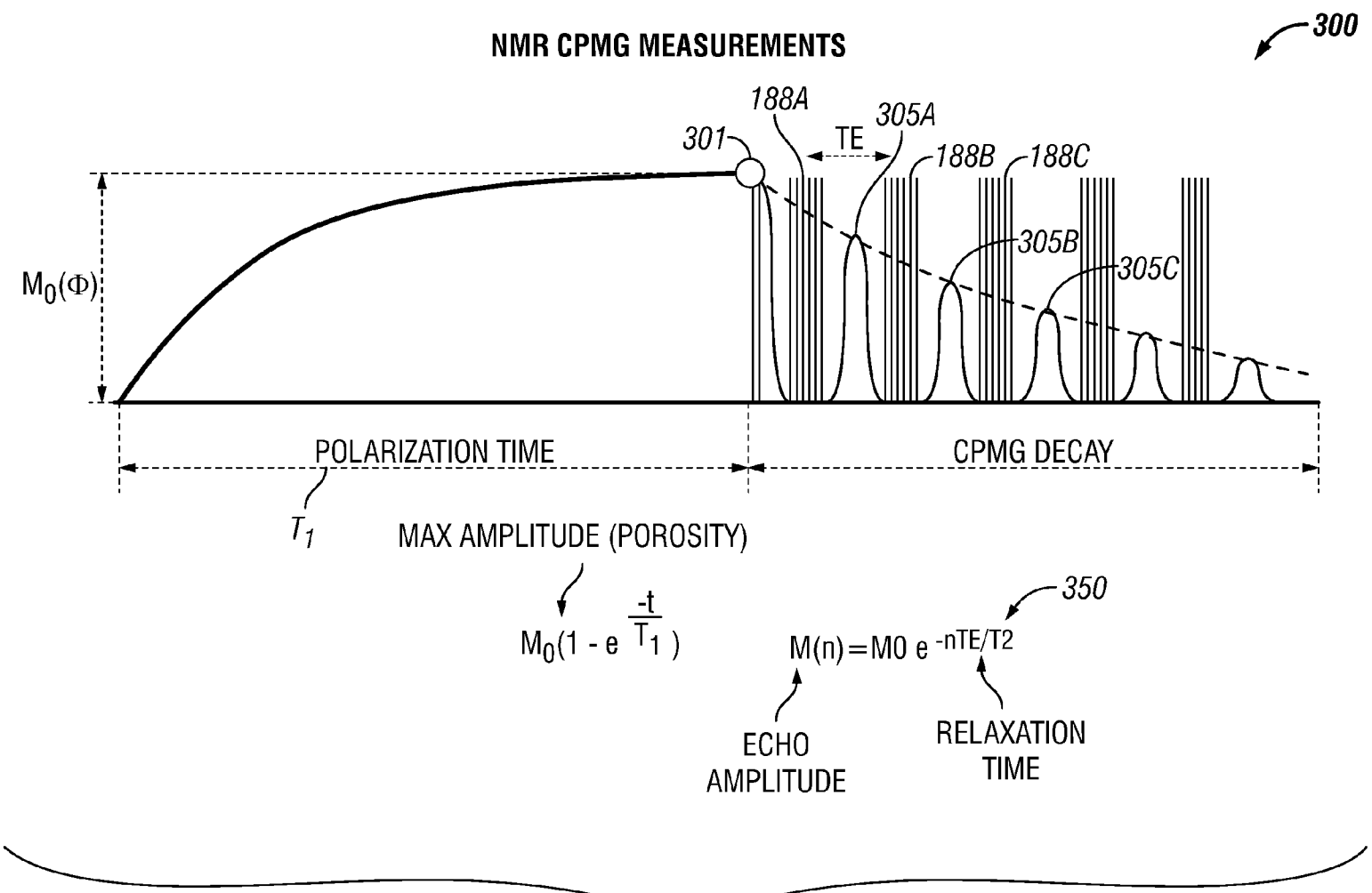
FIG. 3 is a diagram illustrating nuclear magnetic resonance ("NMR") Carr-Purcell-Meiboom-Gill (CPMG) measurements.

FIG. 3 is a diagram illustrating nuclear magnetic resonance ("NMR") Carr-Purcell-Meiboom-Gill (CPMG) measurements. NMR CPMG measurements refer to pulse sequences 188 that are applied after maximum T1 time buildup which occurs at point 301 of graph 300. Graph 300 plots maximum amplitude/intensity (y-axis) of an echo intensity (Mo) against time on the x-axis. The time segment taken to reach the maximum T1 time buildup may be referred to as polarization time. After polarization time and as CPMG pulse sequences 188 are applied, T2 decay is measured. Specifically, CPMG pulse sequences 188 are widely used to measure spin-spin relaxation time T2.

A 180° pulse is applied around the rotating imaginary axis that time τ (tau) to refocus the spins which leads to the formation of the "Hahn" echo time 2τ (tau). Then further applications of 180° pulses 188B, 188C, etc. times 3τ (tau), 5τ (tau), etc. are generated. The NMR echoes occur at the odd tau times (e.g., 3×, 5× etc). When spins are not diffusing, CPMG measurements completely compensate the dephasing of spins due to the local magnetic field inhomogeneities.

Equation 350 of FIG. 3 defines how each echo amplitude 305 is related to its corresponding T2 relaxation time. Equation 350 corresponds to the decay as demonstrated by the decreasing echo amplitude 305 of FIG. 3. The decreasing echo amplitudes 305 of FIG. 3 correspond to the loss of energy described above in connection with FIGS. 2A and 2B which illustrate bulk and surface relaxation.

From the echo amplitude data illustrated in FIG. 3, the T2 values may be calculated by taking the integral of the areas of each echo 305 illustrated in FIG. 3. This integral of each area defined by an echo 305 is plotted in FIG. 4A. FIG. 3 corresponds to blocks 1005-1020 of submethod or routine 930 as will be discussed below in connection with FIGS. 9-10.

Figure 4A:
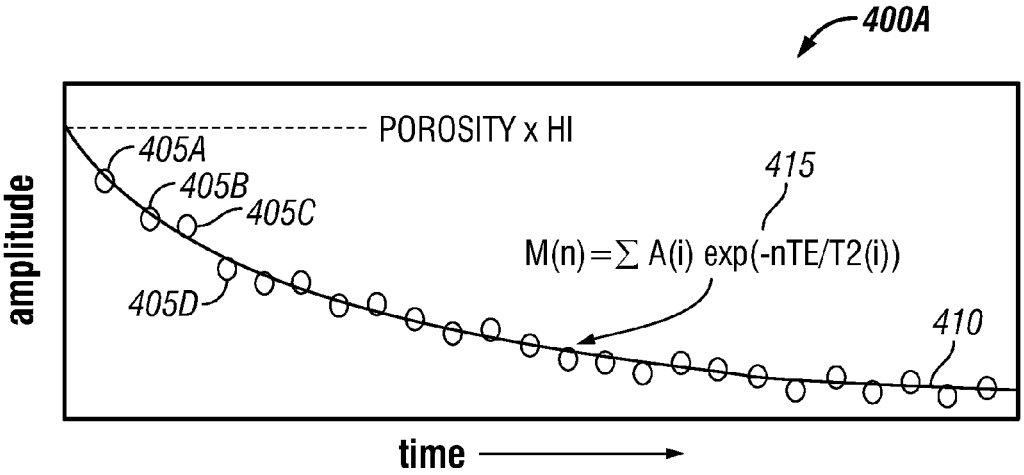
FIG. 4A is graph of time plotted against amplitude for the measurements calculated in FIG. 3.

FIG. 4A is graph 400A of time (x-axis) plotted against amplitude (y-axis) for the measurements calculated in FIG. 3 at one frequency of RF pulses 188. Specifically, each point 405 represents the value for the integral found for each echo 305 plotted in FIG. 3. An exponential (best fit) line 410 is calculated and runs through each of the points 405. This can be calculated in a variety of ways and is well known to those skilled in the arts of signal processing. As equation 415 reflects, the best fit line 410 is equal to the sum of the exponential values represented by each point 405. Meanwhile, the amplitude forming the y-axis may represent porosity and can be calibrated back to the surface measurement of 100% water. The data plotted in FIG. 4A may be transformed using a Laplace transform, resulting in a T2 distribution.

Figure 4B:
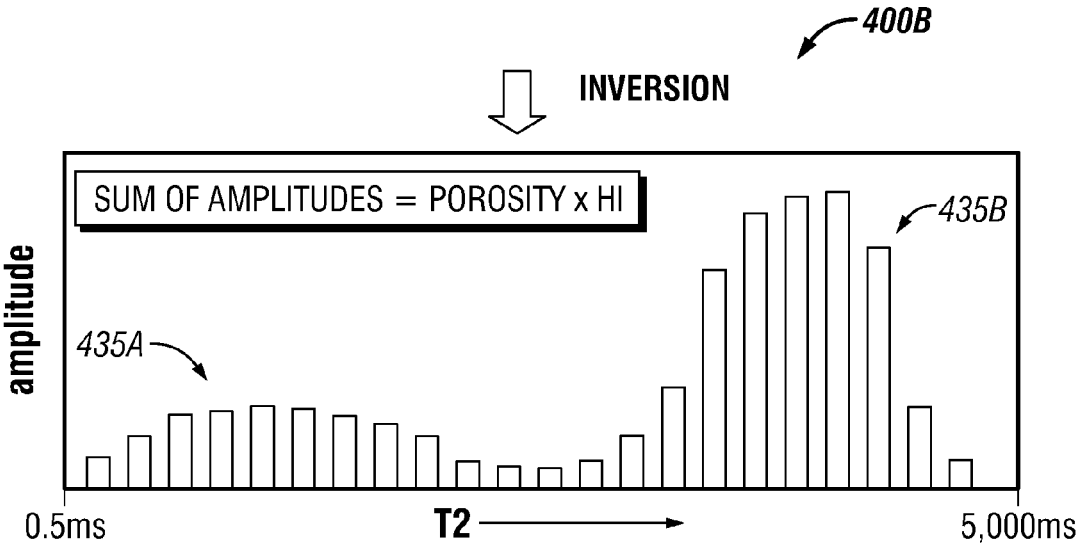
FIG. 4B is a T2 distribution (T2 time plotted against amplitude) derived from the graph of FIG. 4A.

Specifically, FIG. 4B is a T2 distribution (T2 time plotted against amplitude) derived from the data in FIG. 4A in which the data of FIG. 4A is transformed using a Laplace transform. A Laplace transform is often interpreted, by one of ordinary skill in art, as a transformation from the time-domain, in which inputs and outputs are functions of time, to the frequency-domain, where the same inputs and outputs are functions of complex angular frequency, in radians per unit time. FIG. 4A corresponds with blocks 1025 and 1030 of submethod 930 as discussed below in connection with FIG. 10.

FIG. 4B reflects one embodiment of a T2 distribution at one frequency. The x-axis comprises a unit of time such as seconds. Shorter T2 amplitudes 435A (smaller amplitudes or intensities) are on the left side of the graph 400B correspond with lower T2 times while taller T2 amplitudes 435B on the right side of the graph 400B correspond with longer T2 times in this embodiment. The size of the peaks represents the amplitude of the signal of each T2 component. T2 times may range between about 0.3 milliseconds (shorter amplitudes) to about 5000 milliseconds (taller amplitudes). Short T2 times correspond to formations and measure between about 3.0 ms and 33.0 ms while fluids are measured at above about 33 ms. The T2 distribution is plotted over a range of time on the x-axis. When there are largely or completely fluids, the range is generally from 0.3-3000 ms. For a gas, the range can go up to about 5000 ms. Free fluid is anything with a T2 above 33 ms (in sandstones) and 100 ms in carbonates. Water can be ~1000 ms and light oil/gas up to 5000 ms. As indicated in graph 400B, the sum of the amplitudes is equal to porosity multiplied against the hydrogen index (HI).

As noted above, FIGS. 4A-4B are calculated from the NMR caliper 111 operating at one particular frequency. Multiple calculations meaning that multiple graphs 400 are calculated for each frequency over a range or sweep of frequencies. A range of frequencies is used to measure various distances from the NMR caliper 111 as illustrated in FIG. 1C. A particular frequency may represent a single distance measurement relative to a face of the NMR caliper 111.

Figure 5:
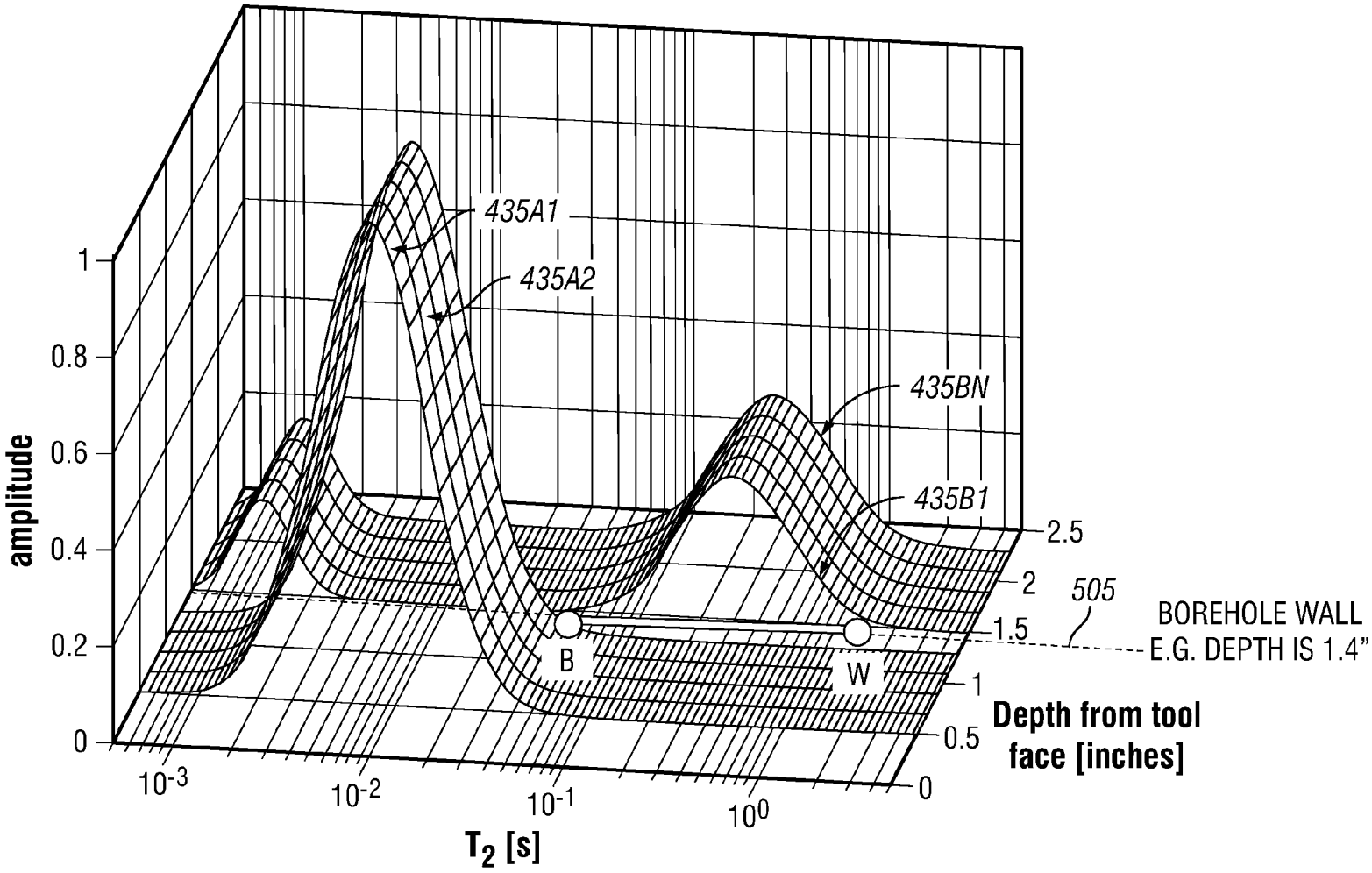
FIG. 5 is a three-dimensional graph of T2 distributions plotted against various depths from an NMR caliper tool face represented by the z-axis.

FIG. 5 is a three-dimensional graph 500 of several T2 distributions plotted against various depths from an NMR caliper tool face represented by the z-axis. Each curve 435 of graph of 500 comprises a T2 distribution, similar to graph 400B of FIG. 4B. That is, if one were to stack a plurality of graphs 400B of FIG. 4B in sequence, then such stacking of these graphs 400B would generate a three-dimensional plot similar to graph 500 of FIG. 5. However, each curve 435 of graph 500 has been truncated to illustrate the highest elements of each T2 distribution.

As noted above, each T2 distribution represented by each curve 435 in FIG. 5 corresponds to one frequency of operation for the NMR caliper 111. For the T2 distributions 435 closest to the X-and Y-axes, these were generated with higher frequencies while T2 distributions farthest from the X- and Y-axes were generated with lower frequencies of the RF pulses 188.

As the T2 distributions are plotted along the z-axis, transitions between relatively short T2 distributions to relatively long T2 distributions will indicate the presence of the borehole wall 11 as indicated by line 505. Specifically, the transition between the T2 distributions where relatively short distributions give way to relatively tall distributions occurs between point "B" and point "W" forming the segment BW as illustrated in FIG. 5. Therefore, FIG. 5 illustrates the depth or distance of the borehole wall 11 from a face from one of the coils 107 such as illustrated in FIG. 1E. The calculations for FIG. 5 are completed by the NMR processing module 101 for each of the four coils 107 as illustrated in FIG. 1E. FIG. 5 corresponds to submethod 1030A of FIG. 11 which will be described in further detail below.

Figure 6:
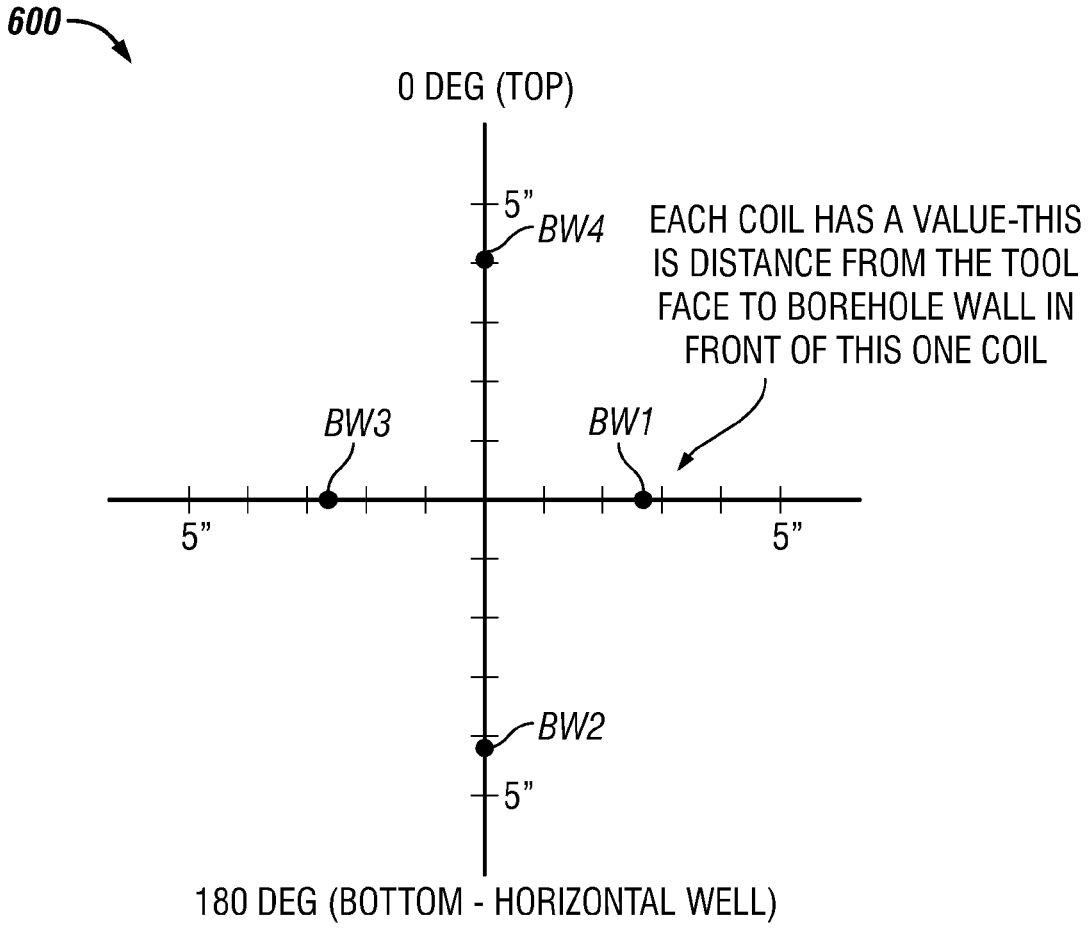
FIG. 6 is a graph of caliper data for a NMR caliper having four coils represented by the four segments of the graph.

FIG. 6 is a graph 600 of caliper data for an NMR caliper 111 having four coils 107 represented by the four segments of the graph 600. Specifically, the center of the Cartesian coordinate system for graph 600 may correspond to the center of an NMR caliper 11. A distance of the borehole wall 11 relative to each of the four coils 107 calculated by the NMR processing module 101 may be plotted in this graph 600. So for each three-dimensional plot 500 of T2 distributions as illustrated in FIG. 5, the borehole wall distance or depth determined from the plot 500 may be represented as a point in the graph 600 of FIG. 6.

If graph 600 represented data from a horizontal well, then the point BW4 would represent a top portion of the well while the point BW2 would represent a bottom portion of the horizontal well. Points BW1 and BW3 would represent sidewalls of the horizontal well. For a vertical well, point BW4 would represent the true north coordinate and point BW2 would represent the true south coordinate as understood by one of ordinary skill in the art.

One of ordinary skill in the art recognizes that additional coils 107 increase the number of points BW that are used to determine the profile or geometry of the borehole wall 11. As more coils 107 are used, then the geometry of the borehole wall 11 may become more accurate. FIG. 6 corresponds with block 1120 of FIG. 11 and with block 1210 of FIG. 12 as will be described in more detail below.

Figure 7:
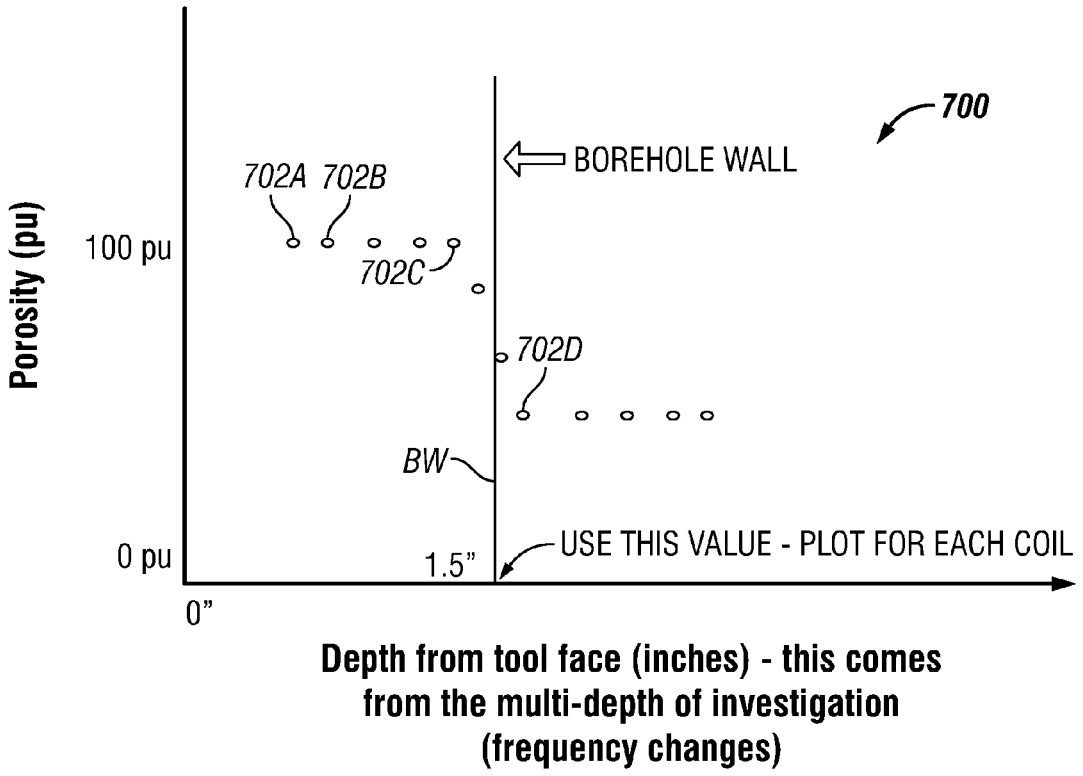
FIG. 7 is a graph of a depth or distance from the face of the NMR caliper plotted against porosity for one coil.

FIG. 7 is a graph of a depth or distance from the face of the NMR caliper 111 plotted against porosity for one coil 107. FIG. 7 illustrates an approach to using the T2 distribution data determined in FIG. 4B. As noted in FIG. 4B, the sum of the amplitudes illustrated in FIG. 4B equals the measured porosity times HI. Porosity has units of measurement equal to the percentage of pore space in a unit volume of rock. It is abbreviated to p.u. and lies between about 0 and about 100. A fluid has a p.u. value of about 100% while rock formations will have percentages of about 40% p.u. and lower. Each T2 distribution illustrated in FIG. 4B represents pulses for one particular frequency at a particular distance from the face of a coil 107 of the NMR caliper 111.

So each point 702 of graph 700 may represent the porosity calculated from a given T 2 distribution, such as the T2 distribution illustrated in FIG. 4B. As illustrated in FIG. 7, as the porosity values begin to drop, this indicates the possibility of the detection of a rock formation. Therefore, between point 702C and point 702D, a transition occurs which is an indicator of the borehole wall represented by line BW in FIG. 7. Once line BW is determined, its x-axis value directly corresponds with the depth or distance from the face of the particular coil 107 which produced the various T2 distributions plotted in this graph 700.

Like the data point determined from graph 500, the x-axis value of graph 700 may be plotted on a Cartesian coordinate system similar to graph 600 of FIG. 6 which represents the four different coils of the NMR caliper 111 of FIG. 1E. FIG. 7 corresponds with block 1205 of FIG. 12 which will be described in further detail below.

Figure 8B:
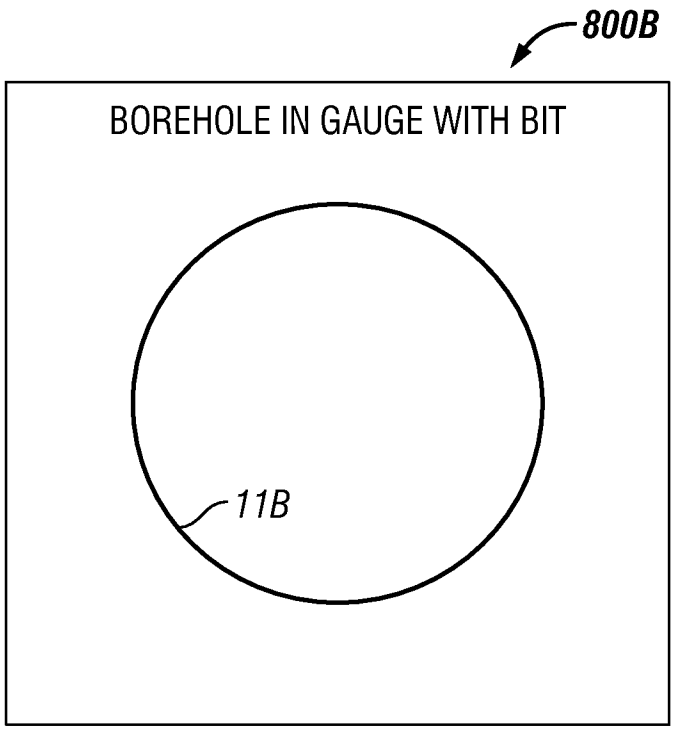
FIG. 8B is an example of a display showing a calculated shape of a borehole from an NMR caliper.
Figure 8A:
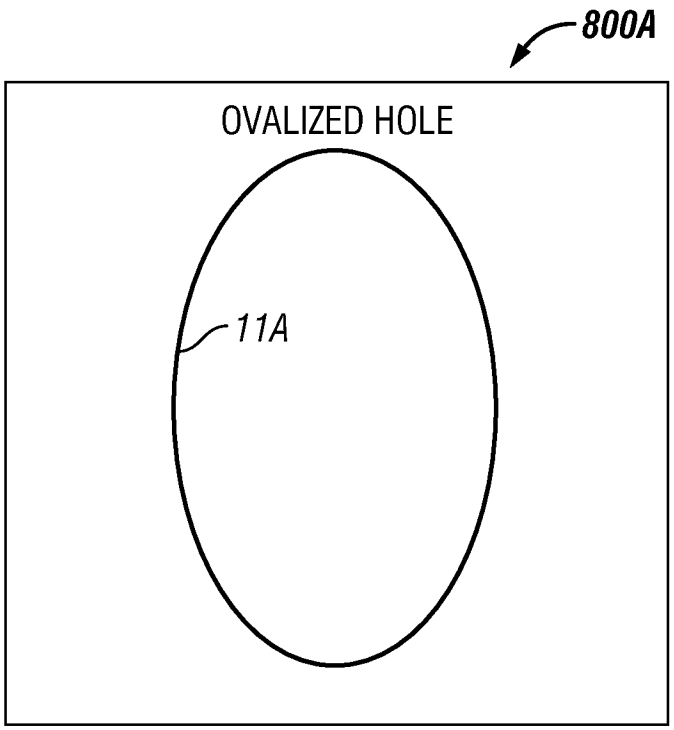
FIG. 8A is an example of a display showing a calculated shape of a borehole from an NMR caliper.

FIG. 8A is an example of a display 800A showing a calculated shape of a borehole 11A from an NMR caliper 111. This display 800A may be generated by the NMR processing module(s) 101 described above which operate the NMR caliper 111. This display 800A may be projected on the display device 147 described above in connection with FIG. 1A.

FIG. 8B is an example of a display 800B showing a calculated shape of a borehole 11B from an NMR caliper 111. This display 800B may be generated by the NMR processing module(s) 101 described above which operate the NMR caliper 111. This display 800B may be projected on the display device 147 described above in connection with FIG. 1A. The shape of the second borehole 11B of FIG. 8B is different relative to the borehole 11B illustrated in FIG. 8A because the second borehole 11B is in closer proximity to the drill bit compared to the borehole 11A of FIG. 8A.

The second borehole 11B has more of a "round" shape while the first borehole 11A has more of an "oval" shape. Changes in borehole shape are often used to explain geomechanical aspects of the formations and is well understood by those skilled in the art.

Figure 9:
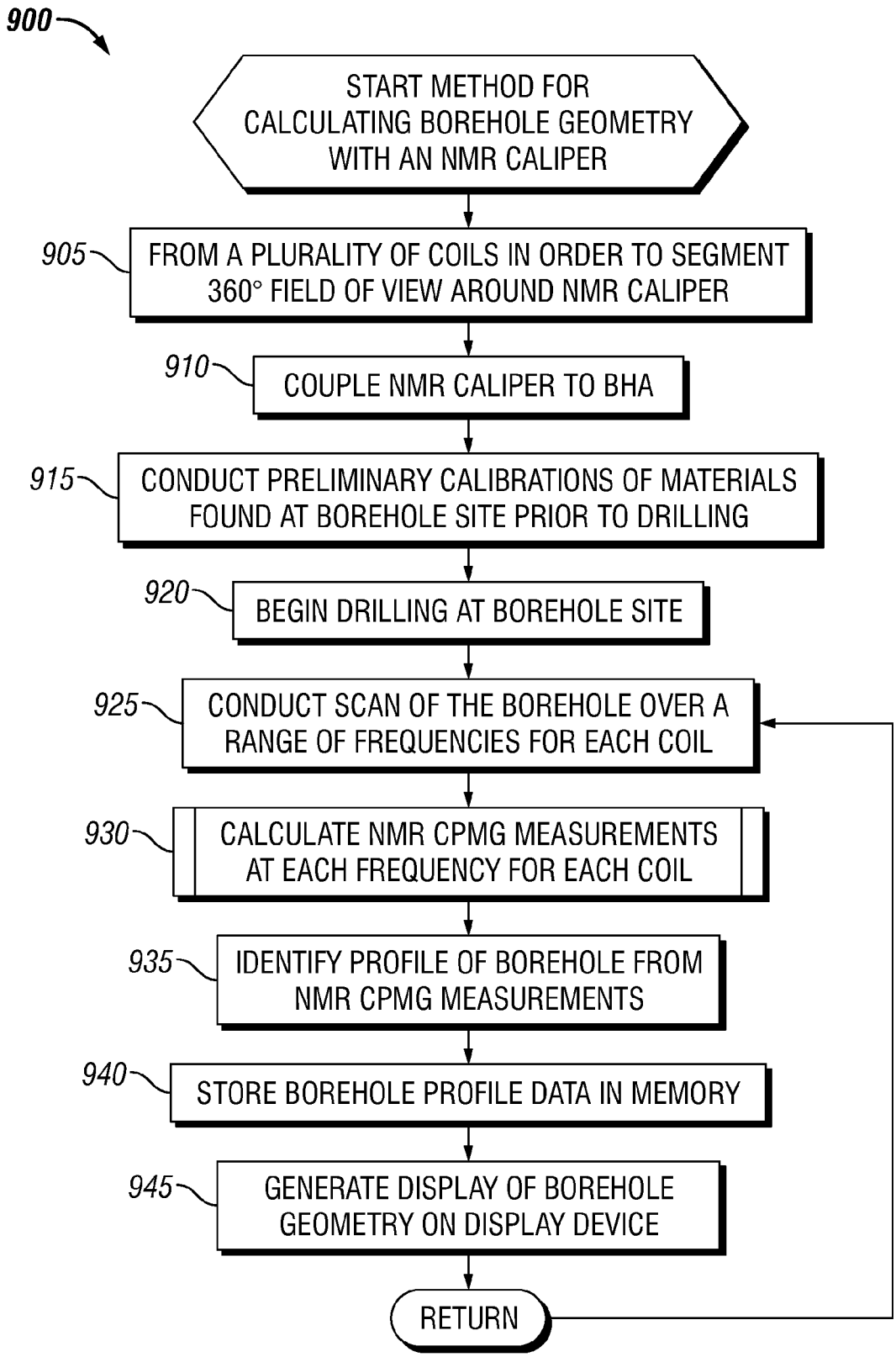
FIG. 9 is a flowchart illustrating a method for calculating borehole geometry with an NMR caliper.

FIG. 9 is a flowchart illustrating a method 900 for calculating borehole geometry with an NMR caliper 111. Block 905 is the first block of the method 900 for calculating borehole geometry with an NMR caliper 111. In block 905, a plurality of coils 107 is formed in order to segment or divide the 360° field of view around the NMR caliper 111. Block 905 generally corresponds with FIGS. 1D-1E which illustrate examples of the coils 107 used in the NMR caliper 111. As discussed above, one of ordinary skill in the art recognizes that any number of coils 107 may be employed and is within the scope of this disclosure.

Next, in block 910, the NMR caliper 111 is coupled to the borehole assembly 100 as illustrated in FIG. 1B. As noted previously, the relative position of the NMR caliper 111 along the borehole assembly 100 may be determined by one of ordinary skill in the art and may be adjusted depending upon the other components and systems that work together to form the borehole assembly 100 as illustrated in FIG. 1B.

In block 915, preliminary calibrations of one or more materials found at the borehole site (near reference numeral 12 as illustrated in FIG. 1B) may be conducted with the NMR processing module(s) 101. Specifically, dirt and/or mud found at the borehole site prior to drilling may be analyzed with the NMR processing modules 101. The NMR caliper 111 may then be calibrated based on the scanning of dirt and/or mud found that the borehole site prior to drilling.

By calibrating the NMR caliper 111 with drilling mud found at the surface of the borehole site prior to drilling, the NMR caliper 111 will be able to use this information to help assign T2 cutoffs for mud and formation T2 times Next, and block 920, the borehole assembly 100 may be activated and drilling may begin at the borehole site. Next, in block 125, the NMR processing module(s) 101 may conduct scans of the borehole over a range of RF frequencies for each coil 107. In this block 920, the NMR caliper 111 generates the series of RF pulses 189 that are used to generate a NMR signal as illustrated in FIG. 1C. As the frequencies decrease, the RF pulses 189 extend further out relative to the face of the NMR caliper 111, based on the Lamour frequency as determined by the static magnetic field. Meanwhile, for very small radiofrequencies, the RF pulses 189 extend very close to the face of the caliper 111.

Next, in routine or submethod 930, the NMR processing module(s) 101 calculate the NMR CPMG measurements at each frequency for each coil 107. Further details of submethod 930 will be described below in connection with FIGS. 10-12. During this routine or submethod 930, each of the coils 107 generates RF pulses 188 as illustrated in FIG. 1C and are at the same frequency for each distance pulsed/scanned. The NMR caliper 111 is operated such that it scans or creates RF pulses over a range of frequencies to cover a range of distances relative to the face of the NMR caliper 111.

In block 935, the NMR processing module(s) 101 identify the profile of the borehole from the NMR CPMG measurements calculated in block 930. This block 935 may correspond with the caliper data represented by the four segments of the graph 600 illustrated in FIG. 6.

Next, and block 940, the NMR processing module(s) 101 may store the borehole profile data in memory, such as in RAM 124, ROM 137, or other storage devices. In block 945, the NMR processing module(s) 101 may generate a display 800A, 800 B for displaying on a display device 147 such as illustrated in FIGS. 8A-8B. The method or process 900 then returns to block 925 for conducting additional scans at the next frequency while the borehole assembly 100 is drilling. The data may also be sent uphole to a surface computer in real-time via a range of communication means known to those skilled in the art. This may include mud telemetry or wired drill pipe.

Figure 10:
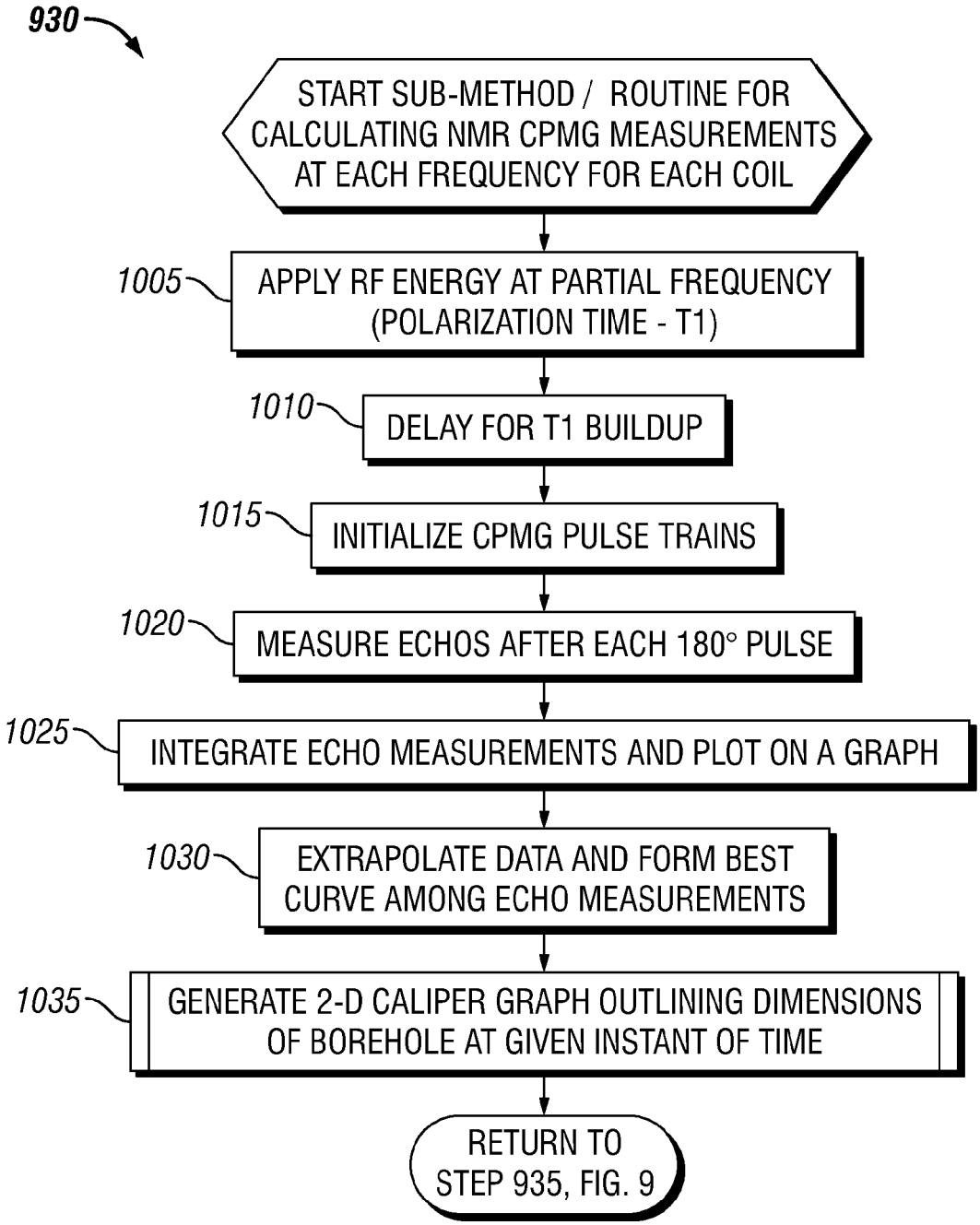
FIG. 10 is a flowchart illustrating a sub-method or routine of FIG. 9 for calculating NMR CPMG measurements as illustrated in FIGS. 3-4.

FIG. 10 is a flowchart illustrating a submethod or routine 930 of FIG. 9 for calculating NMR CPMG measurements as illustrated in FIGS. 3-4. Block 1005 is the first block of submethod 930. In block 1005, radiofrequency energy is applied by each coil 107 at a partial frequency to generate RF pulses 188 as illustrated in FIG. 1C. The NMR processing module(s) 101 issue the commands to generate these RF pulses 188. Block 1005 corresponds to time T1 of the polarization time as illustrated in FIG. 3. Next, in block 1010, the NMR processing module(s) 101 wait for a predetermined amount of time for the T1 time buildup as illustrated in FIG. 3.

Subsequently, in block 1015, the NMR processing module (s) 101 may initialize CPMG pulse trains 188 as illustrated in FIG. 3. Next, and block 1020, the NMR processing module(s) 101 may measure the echoes 305 that occur after each 180 degree RF pulse 188 as illustrated in FIG. 3. In block 1025, the NMR processing module(s) 101 may integrate each of the echo measurements 305 and plot them on a graph such as illustrated in FIG. 4A.

Figure 11:
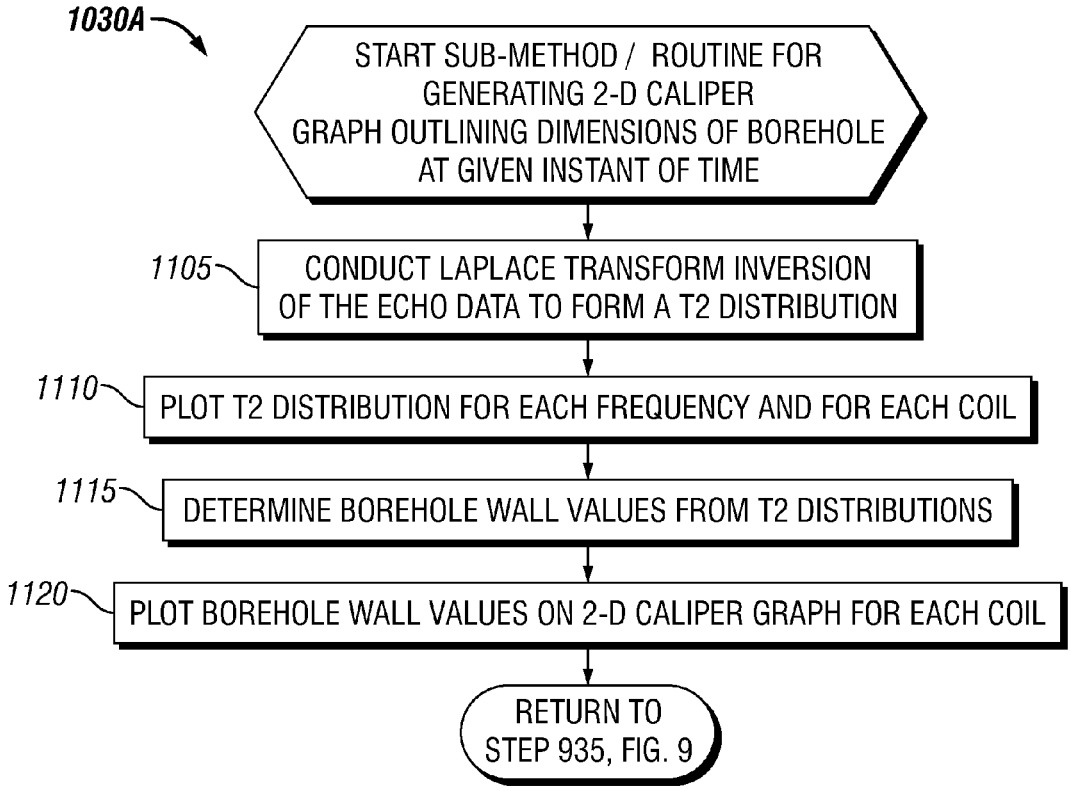
FIG. 11 is a flowchart illustrating a first sub-method or routine of FIG. 9 for generating a 2-D caliper graph outlining dimensions of a borehole at a given instant of time.
Figure 12:
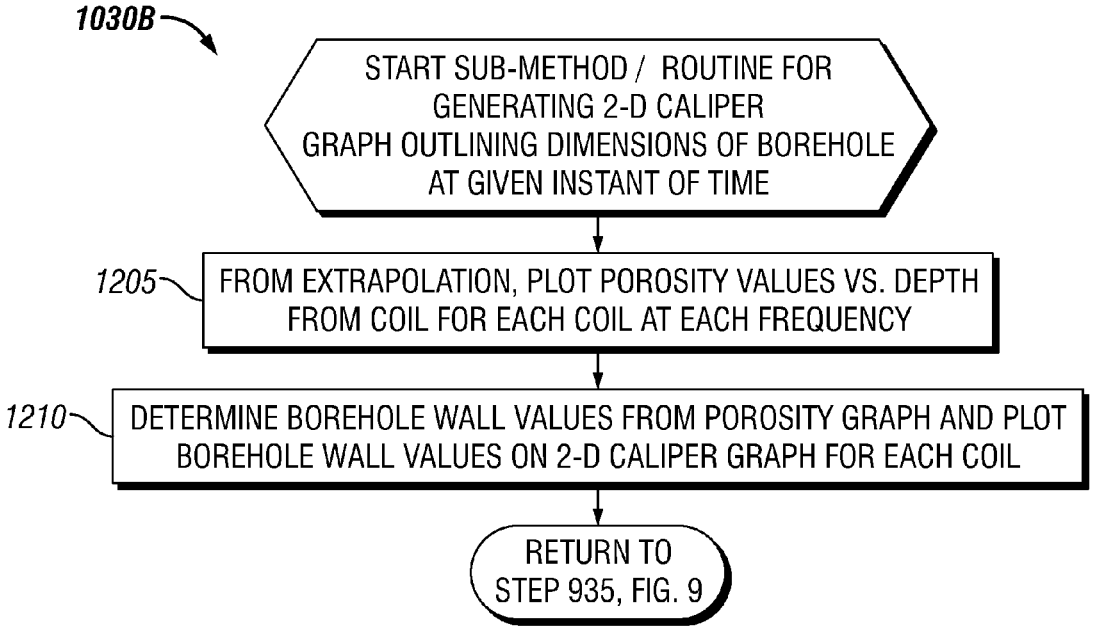
FIG. 12 is a flowchart illustrating a second sub-method or routine of FIG. 9 for generating a 2-D caliper graph outlining dimensions of a borehole at a given instant of time.

In block 1030, the NMR processing module(s) 101 may extrapolate from the data presented in FIG. 4A and form a best fit curve 410 among these echo measurements as understood by one of ordinary skill in the art. Next, in submethod or routine 1030, the NMR processing module(s) 101 may generate a two-dimensional caliper graph of a borehole 11 at a given instant of time such as graph 600 as illustrated in FIG. 6 or a full view of a borehole 11 may be generated similar to displays 800A, 800B of FIG. 8. Further details of submethod 1030 will be described below in connection with FIGS. 11-12. FIG. 11 will illustrate a first version of the submethod 1030 while FIG. 12 illustrate a second version of submethod 1030.

FIG. 11 is a flowchart illustrating a first submethod or routine 1030A of FIG. 9 for generating a 2-D caliper graph 600 (see FIG. 6) outlining dimensions of a borehole 11 at a given instant of time. Block 1105 is the first block of submethod 1030A. In block 1105, the NMR processing module (s) 101 may conduct a Laplace transform inversion of the echo data illustrated in FIG. 4A to form a T2 distribution as illustrated in FIG. 4B as understood by one of ordinary skill in the art. The T2 distribution of FIG. 4B is for a single frequency and for a single coil 107.

In block 1110, the NMR processing module(s) 101 may plot T2 distributions for each frequency scanned and for each coil 107 of the NMR caliper 111 and provide them on a three-dimensional graph as illustrated in FIG. 5. This means that the NMR processing module(s) 101 produce multiple versions of FIG. 4B for each coil as a scan across RF frequencies progresses and the multiple versions of FIG. 4B are projected as geometrical planes along the z-axis as illustrated in FIG. 5.

Next, in block 1115, the NMR processing module(s) 101 may determine the borehole wall values from the T2 distributions projected along the z-axis of FIG. 5. As noted previously, the NMR processing module(s) 101 may determine the points or segments, such as segment BW of FIG. 5, which show a transition between T2 distributions. The transition between T2 distributions defined by shorter T2 times to longer T2 times, like segment BW of FIG. 5, indicates the presence of a borehole wall 11 for a particular coil 107. Each coil 107 of an NMR caliper 111 generates the T2 distributions for a given graph 500 as illustrated in FIG. 5. This means that four separate graphs 500 would be generated for an NMR caliper having four coils 107.

Next, in block 1120, the NMR processing module(s) 101 may plot the borehole wall values on a two-dimensional caliper graph for each coil 107 such as illustrated by graph 600 of FIG. 6. The first submethod 1030A then returns back to block 935 of FIG. 9.

FIG. 12 is a flowchart illustrating a second sub-method or routine 1030B of FIG. 9 for generating a 2-D caliper graph 600 (see FIG. 6) outlining dimensions of a borehole 11 at a given instant of time. Block 1205 is the first block of this second submethod 1030B. In block 1205, the NMR processing module(s) 101 may calculate porosity values against depth for each coil 107 at each frequency scanned by the NMR caliper 111.

Specifically, the NMR processing module(s) 101 may review the amplitude values calculated for each graph 400B of FIG. 4B. As noted previously, each graph 400B is produced by a coil for each frequency. The NMR processing module(s) 101 may convert the amplitudes of FIG. 4B into a single porosity value 702 that indicates porosity at a specific depth or distance (x or y—see FIG. 1C) relative to a face of the NMR caliper 111. Each porosity value 702 may be plotted on a graph such as graph 700 as illustrated in FIG. 7.

Next, in block 1210, after the porosity values 702 across a range of frequencies are determined by the NMR processing module(s) 101 for a single coil 107 are plotted, then borehole wall values may be determined from the graph 700. A transition between the porosity values, such as defined by the segment BW as illustrated in FIG. 7, indicates the presence of a borehole wall 111.

The X-axis of graph 700 illustrates the distance of the borehole wall relative to the face of a single coil 107 of the NMR caliper 111. This distance may then be projected onto a two-dimensional caliper graph, and specifically, onto a single segment of the four segments illustrated in the graph 600 of FIG. 6. This projection of distance from a face of a coil 107 on to graph 600 may be repeated for the remaining coils 107 of the NMR caliper 111. The second submethod then returns to block 935 of FIG. 9.

In this description, the term "application" may also include files having executable content, such as: object code, scripts, byte code, markup language files, and patches. In addition, an "application" referred to herein, may also include files that are not executable in nature, such as documents that may ought to be opened or other data files that ought to be accessed.

The term "content" may also include files having executable content, such as: object code, scripts, byte code, markup language files, and patches. In addition, "content" referred to herein, may also include files that are not executable in nature, such as documents that may ought to be opened or other data files that ought to be accessed.

As used in this description, the terms "component," "database," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device may be a component. One or more components may reside within a process and/or thread of execution, and a component may be localized on one computer and/or distributed between two or more computers. In addition, these components may execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal). A portable computing device may include a cellular telephone, a pager, a PDA, a smartphone, a navigation device, or a hand-held computer with a wireless connection or link.

In this description, the term "application" may also include files having executable content, such as: object code, scripts, byte code, markup language files, and patches. In addition, an "application" referred to herein, may also include files that are not executable in nature, such as documents that may ought to be opened or other data files that ought to be accessed.

The term "content" may also include files having executable content, such as: object code, scripts, byte code, markup language files, and patches. In addition, "content" referred to herein, may also include files that are not executable in nature, such as documents that may ought to be opened or other data files that ought to be accessed.

As used in this description, the terms "component," "database," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device may be a component. One or more components may reside within a process and/or thread of execution, and a component may be localized on one computer and/or distributed between two or more computers. In addition, these components may execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal). A portable computing device may include a cellular telephone, a pager, a PDA, a smartphone, a navigation device, or a hand-held computer with a wireless connection or link.

Certain steps in the processes or process flows described in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the disclosure. In some instances, certain steps may be omitted or not performed without departing from the invention. Further, words such as "thereafter", "then", "next", etc. are not intended to limit the order of the steps. These words are simply used to guide the reader through the description of the sample methods described herein.

Additionally, one of ordinary skill in programming is able to write computer code or identify appropriate hardware and/or circuits to implement the disclosed invention without difficulty based on the flow charts and associated description in this specification, for example.

Therefore, disclosure of a particular set of program code instructions or detailed hardware devices is not considered requisite for an adequate understanding of how to make and use the invention. The inventive functionality of the claimed computer implemented processes is explained in more detail in the above description and in conjunction with the Figures which may illustrate various process flows.

In one or more aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks may reproduce data magnetically, while discs reproduce data optically with lasers. Combinations of the above should also be included within the scope of computer-readable media.

Although just a few embodiments have been described in detail above, those skilled in the art will readily appreciate that many modifications are possible in the embodiments without materially departing from this invention. Accordingly, such modifications are intended to be included within the scope of this disclosure as defined in the following claims.

For example, while multiple coils have been described above, the system may be implemented with a single coil as understood by one of ordinary skill in the art. As the NMR caliper tool 111 rotates, the tool 111 may generate scans that correspond to the four sectors generated by the coils 107A-D as illustrated in FIG. 1E described above. However, using one coil instead of four coils for the NMR caliper tool 111 may increase scanning time four-fold in view of the reduction of the number of coils as understood by one of ordinary skill in the art.

In the claims, means-plus-function clauses are intended to cover the structures described herein as performing the recited function and not solely structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, sixth paragraph for any limitations of any of the claims herein, except for those in which the claim expressly uses the words 'means for' together with an associated function.

What is claimed is:

1. A method for determining a geometry of a borehole comprising:

disposing a nuclear magnetic resonance (NMR) logging device with a plurality of coils into the borehole;

conducting scans of a borehole using each coil of the NMR logging device, wherein conducting scans of the borehole with each coil comprises propagating RF energy at one or more frequencies with each coil, wherein each scan comprises a frequency range from approximately 100 kilohertz (kHz) to 2 megahertz (MHz);

using a processor to determine a borehole wall distance between each coil of the NMR logging device and the borehole based upon NMR measurements derived from the scans, wherein using a processor to determine a borehole wall distance comprises, for each coil:

using the NMR logging tool to obtain a porosity measurement value at each of a selected plurality of frequencies in the frequency range, each of the plurality of selected frequencies corresponding to a different depth of investigation;

using the processor to identify a location of the borehole wall as corresponding to a depth of investigation where a decrease in porosity measurement values is observed; and determining the borehole wall distance between the coil and the borehole wall based on the identified location of the borehole wall;

using the processor to determine the geometry of the borehole based at least partially upon the determined borehole wall distance between each coil and the borehole wall.

2. The method of claim 1, wherein the RF energy is propagated at a single frequency.

3. The method of claim 1, wherein the NMR measurements comprise a plurality of T2 distributions.

4. The method of claim 1, wherein the NMR measurements comprise porosity values derived from the scans.

5. The method of claim 1, further comprising housing the NMR logging device in a logging-while-drilling (LWD) module.

6. The method of claim 1, dividing a 360 degree view of the NMR logging device into a plurality of sectors, each sector being covered by one of the plurality of coils.

7. The method of claim 6, wherein the plurality of coils comprises four coils, each of the four coils covering substantially equal-sized sectors of the 360 degree view.

8. The method of claim 1, monitoring the scans of the borehole with a controller at the surface.

9. The method of claim 1, comprising generating a display of the determined borehole geometry using a display device.

10. A system for determining a geometry of a borehole comprising:

a nuclear magnetic resonance (NMR) logging device having a plurality of coils being configured to, when disposed in the borehole, acquire scans of the borehole using each of the plurality of coils, wherein the NMR logging device is configured to acquire the scans of the borehole using each of the plurality of coils by propagating RF energy at one or more frequencies with each coil, wherein each scan comprises a frequency range from approximately 100 kilohertz (kHz) to 2 megahertz (MHz);

a processing module configured to determine a borehole wall distance between each coil of the NMR logging device and the borehole based at least partially on NMR measurements derived from the scans, and determine the geometry of the borehole based upon the determined borehole wall distance between each coil and the borehole wall;

wherein the NMR logging tool is, for each coil, configured to obtain a porosity measurement value at each of a selected plurality of frequencies in the frequency range, wherein each of the plurality of selected frequencies corresponding to a different depth of investigation; and wherein the processing module is configured to identify a location of the borehole wall as corresponding to a depth of investigation where a decrease in porosity measurement values is observed, and determine the borehole wall distance between the coil and the borehole wall based on the identified location of the borehole wall.

11. The system of claim 10, wherein the processing module is configured to calibrate the NMR logging device using mud found at a surface location.

12. The system of claim 10, further comprising a display device for displaying a borehole profile corresponding to the determined borehole geometry.

13. The system of claim 10, wherein the NMR measurements comprise a plurality of T2 distributions.

14. The system of claim 10, wherein the NMR measurements comprise porosity values derived from the scans.

* * * * *